US007874806B2

(12) United States Patent
Phipps

(10) Patent No.: US 7,874,806 B2
(45) Date of Patent: Jan. 25, 2011

(54) TURBOMACHINE ROTOR BLADE AND A TURBOMACHINE ROTOR

(75) Inventor: Anthony B. Phipps, Uttoxeter (GB)

(73) Assignee: Rolls-Royce plc, London (GB)

( * ) Notice: Subject to any disclaimer, the term of this patent is extended or adjusted under 35 U.S.C. 154(b) by 769 days.

(21) Appl. No.: 11/907,806

(22) Filed: Oct. 17, 2007

(65) Prior Publication Data

US 2008/0095632 A1 Apr. 24, 2008

(30) Foreign Application Priority Data

Oct. 20, 2006 (GB) ..... 0620856.5

(51) Int. Cl.
*F01D 5/30* (2006.01)

(52) U.S. Cl. ..... 416/219 R; 416/221; 416/241 R

(58) Field of Classification Search ..... 416/204 R, 416/215, 216, 217, 219 R, 221, 204 A, 241 R
See application file for complete search history.

(56) References Cited

U.S. PATENT DOCUMENTS

| | | | | |
|---|---|---|---|---|
| 2,809,801 | A | 10/1957 | Curry | |
| 3,076,633 | A | 2/1963 | Bridle et al. | |
| 4,725,200 | A | 2/1988 | Welhoelter | |
| 5,141,401 | A | 8/1992 | Juenger et al. | |
| 5,236,309 | A | 8/1993 | Van Huesden et al. | |
| 5,435,694 | A | 7/1995 | Kray et al. | |
| 5,554,005 | A * | 9/1996 | Nguyen | 416/219 R |
| 6,033,185 | A | 3/2000 | Lammas et al. | |
| 6,250,166 | B1 * | 6/2001 | Dingwell et al. | 73/810 |
| 7,104,759 | B2 * | 9/2006 | Tipton et al. | 416/219 R |

FOREIGN PATENT DOCUMENTS

| | | |
|---|---|---|
| EP | 1 048 821 A2 | 11/2000 |
| GB | 279312 | 3/1927 |
| GB | 609446 | 3/1946 |
| GB | 2 380 770 A | 4/2003 |
| GB | 2 411 442 A | 8/2005 |
| WO | WO 01/71166 A1 | 9/2001 |

* cited by examiner

*Primary Examiner*—Igor Kershteyn
(74) *Attorney, Agent, or Firm*—Oliff & Berridge, PLC

(57) ABSTRACT

A turbomachine rotor includes a plurality of turbomachine rotor blades. The turbomachine rotor has a plurality of firtree shaped slots in its radially outer periphery to form a plurality of rotor posts. The turbomachine rotor blades have correspondingly shaped firtree roots to fit in the firtree shaped slots in the turbomachine rotor. The firtree roots of the turbomachine rotor blades comprise a plurality of radially spaced lobes on each of it flanks. The rotor posts of the turbomachine rotor comprise a plurality of radially spaced lobes on each of its flanks. A radially inner lobe of at least one of the turbomachine rotor blades has reduced stiffness such that the load on the radially inner lobe of the at least one turbomachine rotor blade is shared with the other lobes of the at least one turbomachine rotor blade. Alternatively a radially outer lobe of at least one of the rotor posts has reduced stiffness such that the load on the radially outer lobe of the at least one rotor post is shared with the other lobes of the at least one rotor post.

41 Claims, 2 Drawing Sheets

TURBOMACHINE ROTOR BLADE AND A TURBOMACHINE ROTOR

The present invention relates to a turbomachine blade and a turbomachine rotor and in particular to a gas turbine engine blade and a gas turbine engine rotor, more particularly a turbine blade and a turbine rotor.

In gas turbine engines it is known to secure turbine blades to a turbine rotor, a turbine disc, by providing firtree shaped roots on the turbine blades and correspondingly shaped firtree slots in the periphery of the turbine rotor, turbine disc. The firtree roots of the turbine blades hold the turbine blades onto the turbine rotor. The firtree roots of the turbine blade and the firtree slot of the turbine rotor normally operate at the most extreme of operating conditions experienced by any rotor in a gas turbine engine. The firtree roots of the turbine blades and the firtree slots of the turbine rotor have to meet stringent creep, low cycle fatigue and strength criteria.

In particular the radially innermost lobes on the turbine rotor are difficult to design, due to the requirement for blade cooling holes etc reducing the load carrying area of the radially inner lobes and the fact that all the loads from the turbine blades pass through this area of the turbine rotor. This results in many design compromises and higher than desired stresses for the radially inner lobes of the firtree slots of the turbine rotor. In combination with the high temperatures experienced by the turbine rotor, these factors affect the working life of the turbine rotor and turbine blades.

High localised crushing stresses may initiate micro-cracks, which may propagate.

The turbine disc firtree slots and turbine blade firtree roots normally have a temperature gradient, with the higher temperature at the radially outer periphery of the turbine rotor, and a varying load, with the radially inner lobe(s) of the firtree carrying more load than the radially outer lobe(s) of the firtree. Thus, the radially inner lobe of the firtree has the highest crushing stress and potentially the shortest working life.

Accordingly the present invention seeks to provide a novel turbomachine rotor and/or turbomachine rotor blade which reduces, preferably overcomes, the above-mentioned problem.

Accordingly the present invention provides a turbomachine rotor including a plurality of turbomachine rotor blades, the turbomachine rotor having a plurality of firtree shaped slots in its radially outer periphery to form a plurality of rotor posts, the turbomachine rotor blades having correspondingly shaped firtree roots to fit in the firtree shaped slots in the turbomachine rotor, the firtree roots of the turbomachine rotor blades comprising a plurality of radially spaced lobes on each of it flanks, the rotor posts of the turbomachine rotor comprising a plurality of radially spaced lobes on each of its flanks, a radially inner lobe of at least one of the turbomachine rotor blades having reduced stiffness such that the load on the radially inner lobe of the at least one turbomachine rotor blade is shared with the other lobes of the at least one turbomachine rotor blade or a radially outer lobe of at least one of the rotor posts having reduced stiffness such that the load on the radially outer lobe of the at least one rotor post is shared with the other lobes of the at least one rotor post.

Preferably the radially inner lobe of each of the turbomachine rotor blades having reduced stiffness such that the load on the radially inner lobe of each of the turbomachine rotor blades is shared with the other lobes on the respective turbomachine rotor blade.

Preferably the radially inner base of the firtree root of the at least one turbomachine rotor blade has a recess such that the load on the radially inner lobe of the at least one turbomachine rotor blades is shared with the other lobes on the at least one turbomachine rotor blade.

The recess may extend the full length, or part of the length, of the base of the firtree root. The recess may have a constant width, or different widths, along its length. The recess may have a uniform radial depth, or different radial depths, along its length.

The recess may contain a material with a coefficient of thermal expansion different to the coefficient of thermal expansion of the turbomachine rotor blade. The material may be a coating.

Preferably the radially outer lobe of each of the rotor posts having reduced stiffness such that the load on the radially outer lobe of each of the rotor posts is shared with the other lobes on the respective rotor post.

Preferably the radially outer periphery of the at least one rotor post has a recess such that the load on the radially outer lobe of the at least one rotor post is shared with the other lobes on the at least one rotor post.

The recess may extend the full length, or part of the length, of the periphery of the rotor post. The recess may have a constant width, or different widths, along its length. The recess may have a uniform radial depth, or different radial depths, along its length.

The recess may contain a material with a coefficient of thermal expansion different to the coefficient of thermal expansion of the rotor post. The material may be a coating.

Preferably the turbomachine rotor is a turbine rotor and turbomachine rotor blade is a turbine blade.

Preferably the turbomachine rotor is a gas turbine engine rotor and the turbomachine rotor blade is a gas turbine engine rotor blade.

The present invention also provides a turbomachine rotor having a plurality of firtree shaped slots in its radially outer periphery to form a plurality of rotor posts, the rotor posts of the turbomachine rotor comprising a plurality of radially spaced lobes on each of its flanks, a radially outer lobe of at least one of the rotor posts having reduced stiffness such that the load on the radially outer lobe of the at least one rotor post is shared with the other lobes of the at least one rotor post.

Preferably the radially outer lobe of each of the rotor posts having reduced stiffness such that the load on the radially outer lobe of each of the rotor posts is shared with the other lobes on the respective rotor post.

Preferably the radially outer periphery of the at least one rotor post has a recess such that the load on the radially outer lobe of the at least one rotor post is shared with the other lobes on the at least one rotor post.

The recess may extend the full length, or part of the length, of the base of the rotor post. The recess may have a constant width, or different widths, along its length. The recess may have a uniform radial depth, or different radial depths, along its length.

The recess may contain a material with a coefficient of thermal expansion different to the coefficient of thermal expansion of the at least one rotor post. The material may be a coating.

Preferably the turbomachine rotor is a turbine rotor.

Preferably the turbomachine rotor is a gas turbine engine rotor.

The present invention also provides a turbomachine rotor blade having a firtree shaped root, the firtree root of the turbomachine rotor blade comprising a plurality of radially spaced lobes on each of it flanks, a radially inner lobe of the turbomachine rotor blade having reduced stiffness such that the load on the radially inner lobe of the turbomachine rotor blade is shared with the other lobes of the turbomachine rotor blade.

Preferably the radially inner base of the firtree root of the turbomachine rotor blade has a recess such that the load on the radially inner lobe of the turbomachine rotor blade is shared with the other lobes on the turbomachine rotor blade.

The recess may extend the full length, or part of the length, of the base of the firtree root. The recess may have a constant width, or different widths, along its length. The recess may have a uniform radial depth, or different radial depths, along its length.

The recess may contain a material with a coefficient of thermal expansion different to the coefficient of thermal expansion of the turbomachine rotor blade. The material may be a coating.

Preferably the turbomachine rotor blade is a turbine blade.

Preferably the turbomachine rotor blade is a gas turbine engine rotor blade.

The present invention will be more fully described by way of example with reference to the accompanying drawings in which.

Figure 1:
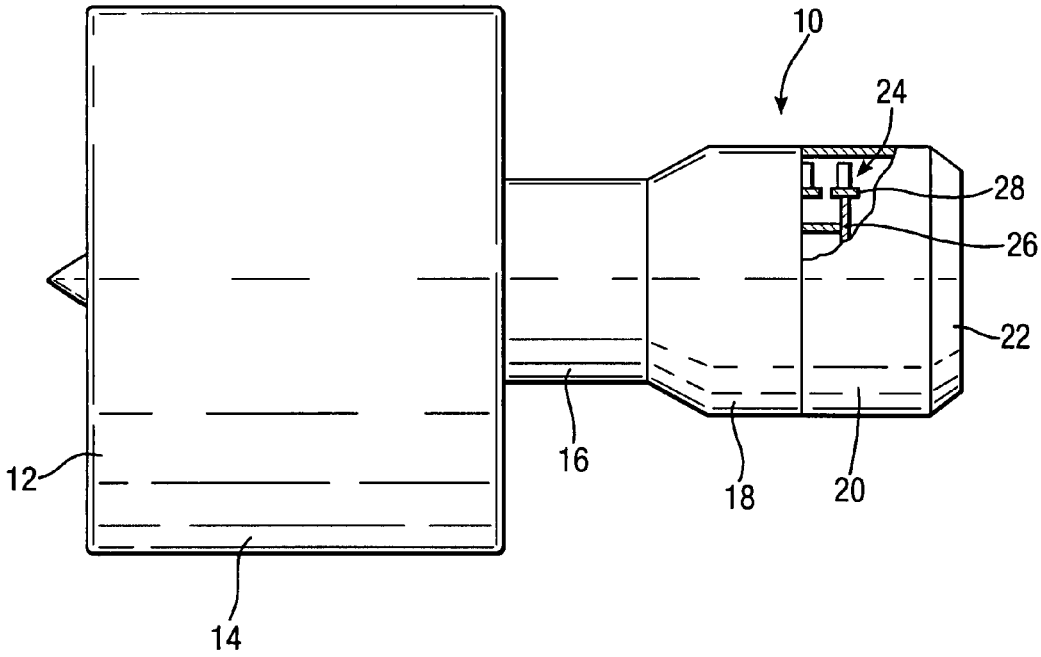
FIG. 1 shows a turbofan gas turbine engine having a turbine rotor and a turbine blade according to the present invention.

A turbofan gas turbine engine 10, as shown in FIG. 1, comprises in axial flow series an intake 12, a fan section 14, a compressor section 16, a combustion section 18, a turbine section 20 and an exhaust 22. The turbine section 20 comprises a high-pressure turbine 24 arranged to drive a high-pressure compressor (not shown) in the compressor section via a shaft (not shown), an intermediate-pressure turbine (not shown) arranged to drive an intermediate-pressure compressor (not shown) and a low-pressure turbine (not shown) arranged to drive a fan (not shown) in the fan section 14.

Figure 2:
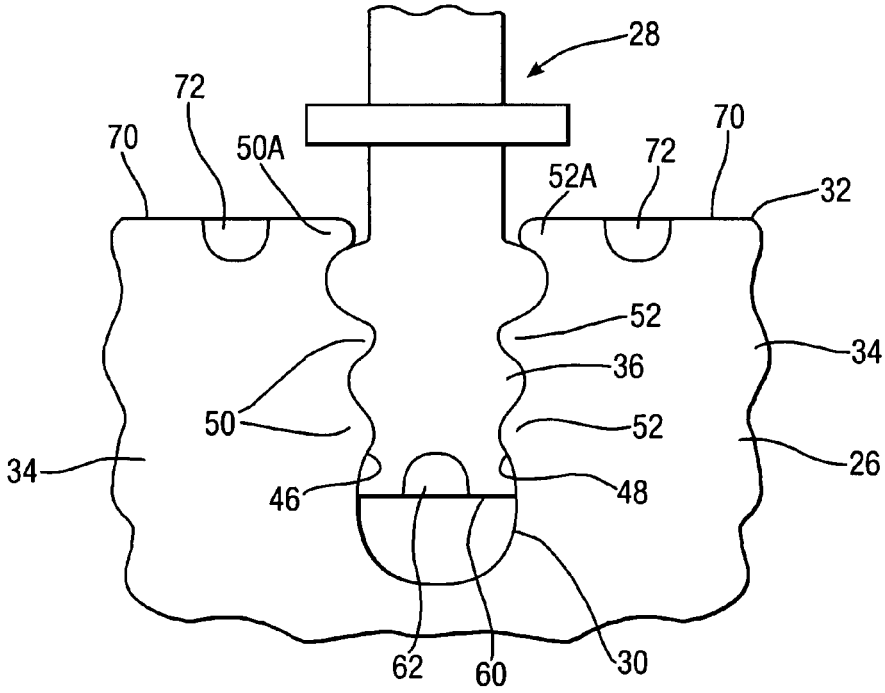
FIG. 2 shows is an enlarged view of a turbine rotor according to the present invention.
Figure 3:
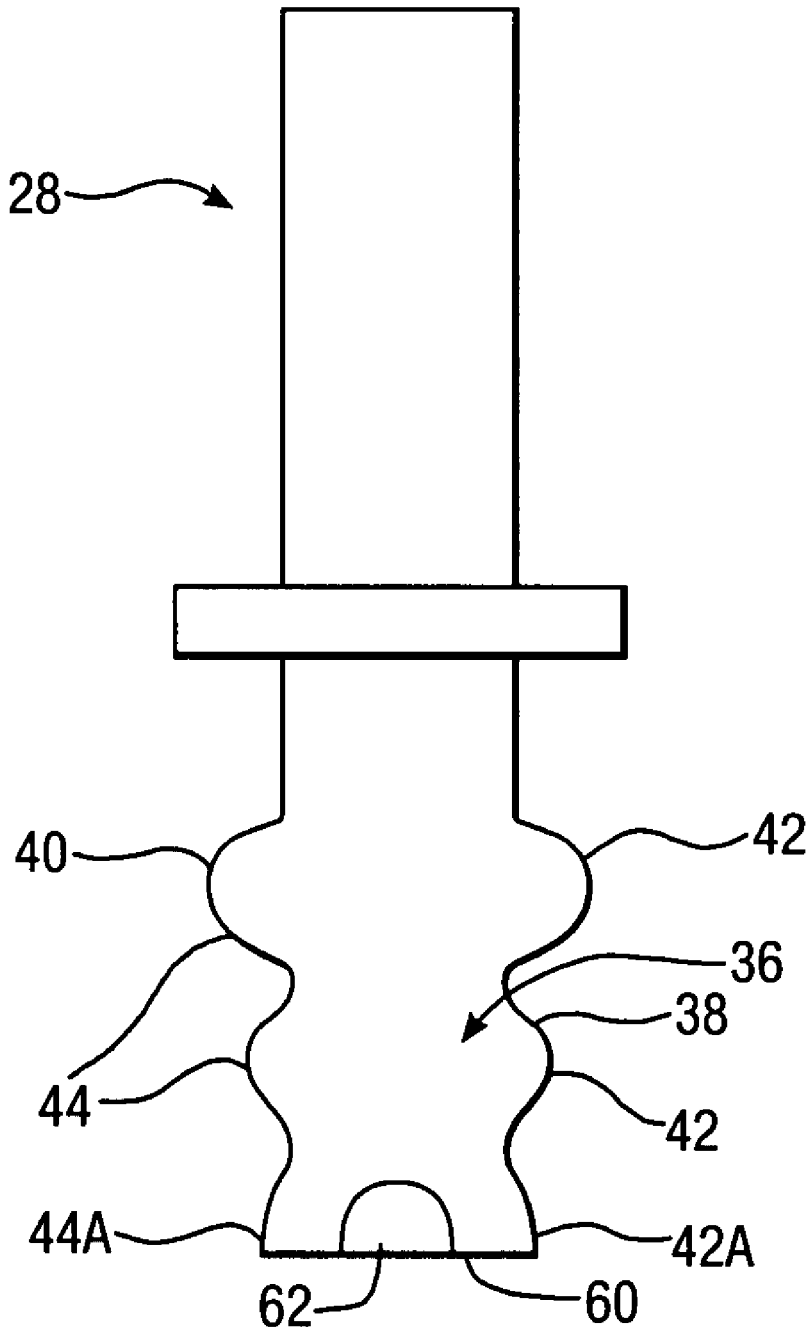
FIG. 3 shows is an enlarged view of a turbine blade according to the present invention.

The high-pressure turbine 24, shown more clearly in FIGS. 2 and 3, comprises a high-pressure turbine rotor, or turbine disc, 26 which carries a plurality of circumferentially spaced radially outwardly extending turbine blades 28. The turbine rotor 26 has a plurality circumferentially spaced generally axially extending firtree shaped slots 30 in its radially outer periphery 32 which form a plurality of circumferentially spaced rotor posts 34. The turbine blades 28 have correspondingly shaped firtree roots 36 to fit in the firtree shaped slots 30 in the periphery 32 of the turbine rotor 26. The firtree roots 36 of the turbine blades 28 comprise a plurality of radially spaced lobes 42, 44 on each of it circumferentially spaced axially extending flanks 38, 40 respectively and similarly the rotor posts 34 of the turbine rotor 26 comprise a plurality of radially spaced lobes 50, 52 on each of its radially spaced axially extending flanks 46, 48 respectively.

A radially inner lobe 42A on the flank 38 of the firtree root 36 of each of the turbine blades 28 has reduced stiffness such that the load on the radially inner lobe 42A on the flank 38 of each of the turbine blades 28 is shared with the other lobes 42 on the flank 38 of the respective turbine blade 28. Similarly a radially inner lobe 44A on the flank 40 of the firtree root 36 each of the turbine blades 28 has reduced stiffness such that the load on the radially inner lobe 44A on the flank 40 of each of the turbine blades 28 is shared with the other lobes 44 on the flank 40 of the respective turbine blade 28.

The firtree root 36 of each turbine blade 28 has a radially inner base 60 and the radially inner base 60 of the firtree root 36 of each turbine blade 28 has a recess 62 such that the load on the radially inner lobes 42A, 44A of each turbine blade 28 is shared with the other lobes 42, 44 on the firtree root 36 of the respective turbine blade 28. The recess 62 may extend the full axial length, or part of the axial length, of the base 60 of the firtree root 36 of the turbine blade 28. The recess 62 may have a constant width, or different widths, along its axial length. The recess may have a uniform radial depth, or different radial depths, along its axial length.

The recess 62 may contain a material with a coefficient of thermal expansion different to the coefficient of thermal expansion of the turbine blade 28, and the material may be a coating.

A radially outer lobe 50A on the flank 46 of each of the rotor posts 34 has reduced stiffness such that the load on the radially outer lobe 50A on the flank 46 of each rotor post 34 is shared with the other lobes 50 on the flank 46 of the respective rotor post 34. Similarly a radially outer lobe 52A on the flank 48 of each of the rotor posts 34 has reduced stiffness such that the load on the radially outer lobe 52A on the flank 48 of each rotor post 34 is shared with the other lobes 52 on the flank 48 of the respective rotor post 34.

Each rotor post 34 of the turbine rotor 24 has a radially outer periphery 70 and the radially outer periphery 70 of each rotor post 34 has a recess 72 such that the load on the radially outer lobes 50A, 52A of each rotor post 34 is shared with the other lobes 50, 52 on the respective rotor post 34. The recesses 72 may extend the full axial length, or part of the axial length, of the periphery 70 of the rotor posts 34. The recess 72 may have a constant width, or different widths, along its axial length. The recesses 72 may have a uniform radial depth, or different radial depths, along its axial length.

The recesses 72 may contain a material with a coefficient of thermal expansion different to the coefficient of thermal expansion of the rotor posts 34 and the material may be a coating.

The provision of a recess in the base of a firtree root of a turbine blade reduces the stiffness of the firtree root at the radially inner most lobes and this shares the load with all the other lobes on both of the flanks of the firtree root. This sharing of the load increases the life of the radially inner most lobes on the firtree root of the turbine blade. The provision of the recess in the base of the firtree root of the turbine blade produces a thinner thickness of material, which has lower stiffness and hence lower load-carrying ability than a base without a recess.

The provision of different circumferential widths and different radial depths of the recess in the base of the firtree root may be used to produce different shaped recesses and to produce differences in stiffness at different positions to allow for other features of the turbine blade, e.g. cooling passages, stiffening features in the turbine blade. The shape and dimensions of the recess may be adjusted to optimise the turbine blade/turbine rotor assembly working life.

Similarly the provision of a recess in the periphery of a disc post of a turbine rotor reduces the stiffness of the disc post at the radially outer most lobes and this shares the load with all the other lobes on both of the flanks of the disc post. This sharing of the load increases the life of the radially outer most lobes on the disc post of the turbine rotor. The provision of the recess in the periphery of the disc post of the turbine rotor produces a thinner thickness of material, which has lower stiffness and hence lower load-carrying ability than a periphery without a recess.

The provision of different circumferential widths and different radial depths of the recess in the periphery of the disc post may be used to produce different shaped recesses and to produce differences in stiffness at different positions to allow for other features of the disc post. The shape and dimensions of the recess may be adjusted to optimise the turbine blade/turbine rotor assembly working life.

Although the present invention has been described with reference to recesses being provided in both the disc posts and the firtree roots of the turbine blades it is equally possible to provide recesses only in the disc posts or only in the firtree roots of the turbine blades. It may be possible to provide a recess in the firtree roots of at least one of the turbine blades or to provide a recess in at least one of the disc posts of the turbine rotor.

The recesses in the base of the firtree and/or the periphery of the disc posts may be provided with material, e.g. thick coatings, diffused sections etc, which have different coefficient of thermal expansion to the firtree root or disc post such that there would be a variation of stiffness of the radially inner lobes of the firtree root and/or a variation of stiffness of the radially outer lobes of the disc posts with temperature.

An advantage of the present invention is that is that it may be applied retrospectively to turbine rotors and/or turbine blades once the stresses/loads have been verified in engine testing and/or rig testing.

Although the present invention has been described with reference to a turbine rotor and turbine blades the present invention is applicable to other turbomachine rotor and turbomachine rotor blades, e.g. compressor rotors and compressor blades.

Although the present invention has been described with reference to a gas turbine engine rotor and a gas turbine engine rotor blade the present invention is applicable to other turbomachine rotor and turbomachine rotor blades.

I claim:

1. A turbomachine rotor assembly comprising a turbomachine rotor and a plurality of turbomachine rotor blades, the turbomachine rotor having a plurality of firtree shaped slots in its radially outer periphery to form a plurality of rotor posts, the turbomachine rotor blades having correspondingly shaped firtree roots to fit in the firtree shaped slots in the turbomachine rotor, the firtree roots of the turbomachine rotor blades comprising circumferentially spaced flanks, a plurality of radially spaced lobes on each of the flanks and a radially inner base, the rotor posts of the turbomachine rotor comprising circumferentially spaced flanks, a plurality of radially spaced lobes on each of the flanks and a radially outer periphery, a radially inner lobe of at least one of the turbomachine rotor blades having reduced stiffness such that the load on the radially inner lobe of the at least one turbomachine rotor blade is shared with the other lobes of the at least one turbomachine rotor blade, the radially inner base of the firtree root of the at least one turbomachine rotor blade has a recess such that the load on the radially inner lobe of the at least one turbomachine rotor blades is shared with the other lobes on the at least one turbomachine rotor blade, or a radially outer lobe of at least one of the rotor posts having reduced stiffness such that the load on the radially outer lobe of the at least one rotor post is shared with the other lobes of the at least one rotor post, the radially outer periphery of the at least one rotor post has a recess such that the load on the radially outer lobe of the at least one rotor post is shared with the other lobes on the at least one rotor post.

2. A turbomachine rotor assembly as claimed in claim 1 wherein the recess extends at least a part of the axial length of the base of the firtree root.

3. A turbomachine rotor assembly as claimed in claim 2 wherein the recess extends the full axial length of the base of the firtree root.

4. A turbomachine rotor assembly as claimed in claim 1 wherein the recess has a constant circumferential width along its length.

5. A turbomachine rotor assembly as claimed in claim 1 wherein the recess has different circumferential widths along its length.

6. A turbomachine rotor assembly as claimed in claim 1 wherein the recess has a uniform radial depth along its length.

7. A turbomachine rotor assembly as claimed in claim 1 wherein the recess has different radial depths along its length.

8. A turbomachine rotor assembly as claimed in claim 1 wherein the recess contains a material with a coefficient of thermal expansion different to the coefficient of thermal expansion of the turbomachine rotor blade.

9. A turbomachine rotor assembly as claimed in claim 8 wherein the material is a coating.

10. A turbomachine rotor assembly as claimed in claim 1 wherein the recess extends at least a part of the axial length of the periphery of the rotor post.

11. A turbomachine rotor assembly as claimed in claim 1 wherein the recess extends the full axial length of the periphery of the rotor post.

12. A turbomachine rotor assembly as claimed in claim 1 wherein the recess has a constant circumferential width along its axial length.

13. A turbomachine rotor assembly as claimed in claim 1 wherein the recess has circumferential different widths along its axial length.

14. A turbomachine rotor assembly as claimed in claims 1 wherein the recess has a uniform radial depth along its axial length.

15. A turbomachine rotor assembly as claimed in claim 1 wherein the recess has different radial depths along its axial length.

16. A turbomachine rotor assembly as claimed in claim 1 wherein the recess contains a material with a coefficient of thermal expansion different to the coefficient of thermal expansion of the rotor post.

17. A turbomachine rotor assembly as claimed in claim 16 wherein the material is a coating.

18. A turbomachine rotor assembly as claimed in claim 1 wherein the turbomachine rotor is a turbine rotor and turbomachine rotor blade is a turbine blade.

19. A turbomachine rotor assembly as claimed in claim 1 wherein the turbomachine rotor is a gas turbine engine rotor and the turbomachine rotor blade is a gas turbine engine rotor blade.

20. A turbomachine rotor having a plurality of firtree shaped slots in its radially outer periphery to form a plurality of rotor posts, the rotor posts of the turbomachine rotor comprising circumferentially spaced flanks, a plurality of radially spaced lobes on each of the flanks and a radially outer periphery, a radially outer lobe of at least one of the rotor posts having reduced stiffness such that the load on the radially outer lobe of the at least one rotor post is shared with the other lobes of the at least one rotor post, the radially outer periphery of the at least one rotor post has a recess such that the load on the radially outer lobe of the at least one rotor post is shared with the other lobes on the at least one rotor post.

21. A turbomachine rotor as claimed in claim 20 wherein the recess extends at least a part of the axial length of the base of the rotor post.

22. A turbomachine rotor as claimed in claim 21 wherein the recess extends the full axial length of the base of the rotor post.

23. A turbomachine rotor as claimed in claim 20 wherein the recess has a constant circumferential width along its axial length.

24. A turbomachine rotor as claimed in claim 20 wherein the recess has different circumferential widths along its axial length.

25. A turbomachine rotor as claimed in claim 20 wherein the recess has a uniform radial depth along its axial length.

26. A turbomachine rotor as claimed in claim 20 wherein the recess has different radial depths along its axial length.

27. A turbomachine rotor as claimed in claim 20 wherein the recess contains a material with a coefficient of thermal expansion different to the coefficient of thermal expansion of the at least one rotor post.

28. A turbomachine rotor as claimed in claim 27 wherein the material is a coating.

29. A turbomachine rotor as claimed in claim 20 wherein the turbomachine rotor is a turbine rotor.

30. A turbomachine rotor as claimed in claim 20 wherein the turbomachine rotor is a gas turbine engine rotor.

31. A turbomachine rotor blade having a firtree shaped root, the firtree root of the turbomachine rotor blade comprising circumferentially spaced flanks, a plurality of radially spaced lobes on each of its flanks and a radially inner base, a radially inner lobe of the turbomachine rotor blade having reduced stiffness such that the load on the radially inner lobe of the turbomachine rotor blade is shared with the other lobes of the turbomachine rotor blade, the radially inner base of the firtree root of the turbomachine rotor blade has a recess such that the load on the radially inner lobe of the turbomachine rotor blade is shared with the other lobes on the turbomachine rotor blade.

32. A turbomachine rotor blade as claimed in claim 31 wherein the recess extends at least a part of the axial length of the base of the firtree root.

33. A turbomachine rotor blade as claimed in claim 31 wherein the recess extends the full axial length of the base of the firtree root.

34. A turbomachine rotor blade as claimed in claim 31 wherein the recess has a constant circumferential width along its axial length.

35. A turbomachine rotor blade as claimed in claim 31 wherein the recess has different circumferential widths along its axial length.

36. A turbomachine rotor blade as claimed in claim 31 wherein the recess has a uniform radial depth along its axial length.

37. A turbomachine rotor blade as claimed in claim 31 wherein the recess has different radial depths along its axial length.

38. A turbomachine rotor blade as claimed in claim 31 wherein the recess contains a material with a coefficient of thermal expansion different to the coefficient of thermal expansion of the turbomachine rotor blade.

39. A turbomachine rotor blade as claimed in claim 38 wherein the material is a coating.

40. A turbomachine rotor blade as claimed in claim 31 wherein the turbomachine rotor blade is a turbine blade.

41. A turbomachine rotor blade as claimed in claim 31 wherein the turbomachine rotor blade is a gas turbine engine rotor blade.

* * * * *